US005881615A

United States Patent [19]

Dahl et al.

[11] Patent Number: 5,881,615

[45] Date of Patent: Mar. 16, 1999

[54] MULTIPLE BIT SCREWDRIVERS AND METHODS

[75] Inventors: Todd Kevin Dahl, Burnsville; Dale D. Elvebak, Alberta Lea, both of Minn.

[73] Assignee: Enderes Tool Company, Inc., Apple Valley, Minn.

[21] Appl. No.: 784,246

[22] Filed: Jan. 15, 1997

[51] Int. Cl.[6] ..... B25G 1/08

[52] U.S. Cl. ..... 81/490; 81/177.4; 16/110.5

[58] Field of Search ..... 81/177.4, 490; 16/110.5

[56] References Cited

U.S. PATENT DOCUMENTS

| | | |
|---|---|---|
| D. 358,316 | 5/1995 | Markwart et al. . |
| D. 373,297 | 9/1996 | Hill . |
| 3,405,749 | 10/1968 | Butler . |
| 3,683,984 | 8/1972 | Hull . |
| 3,753,455 | 8/1973 | Butler . |
| 4,273,173 | 6/1981 | Smith et al. . |
| 4,327,790 | 5/1982 | Stevens et al. . |
| 4,372,361 | 2/1983 | Whiteford . |
| 4,372,362 | 2/1983 | Ahn . |
| 4,434,828 | 3/1984 | Trincia . |
| 4,440,048 | 4/1984 | Stevens et al. . |
| 4,463,788 | 8/1984 | Corona et al. . |
| 4,552,043 | 11/1985 | Corona et al. . |
| 4,552,044 | 11/1985 | Corona et al. . |
| 4,572,038 | 2/1986 | Graham . |
| 4,716,795 | 1/1988 | Corona et al. . |
| 4,735,120 | 4/1988 | Beugelsdyk . |
| 4,793,222 | 12/1988 | Beugelsdyk . |
| 4,827,812 | 5/1989 | Markovetz . |
| 4,901,607 | 2/1990 | Beugelsdyk et al. . |
| 4,924,733 | 5/1990 | McKenzie . |
| 5,265,504 | 11/1993 | Fruhm . |
| 5,325,745 | 7/1994 | Koehler . |
| 5,335,409 | 8/1994 | Elvebak . |
| 5,460,063 | 10/1995 | Hodgson . |
| 5,499,562 | 3/1996 | Feng ..... 81/490 X |
| 5,517,885 | 5/1996 | Feng . |
| 5,675,866 | 10/1997 | Tseng ..... 81/177.4 X |

OTHER PUBLICATIONS

Photographs of Tacoma Screw Products multi–bit screwdriver (1 page).

Photographs of a Vaco–Matic multi–bit screwdriver No. 70427 (1 page).

Photographs of a Westcon Products Co. multi–bit screwdriver (1 page).

*Primary Examiner*—James G. Smith

*Attorney, Agent, or Firm*—Merchant, Gould, Smith, Edell, Welter and Schmidt, P.A.

[57] ABSTRACT

The present invention relates to a screwdriver adapted for use with one or more replaceable bits. The screwdriver includes a shaft adapted to selectively form a torque transmitting engagement with the bit. A handle is mounted on the shaft. The handle includes an outwardly opening groove sized and shaped for receiving and storing each bit. Each groove extends longitudinally along the length of the handle. The handle also includes a panel for selectively retaining the bit in each groove. The panel is constructed and arranged to slide longitudinally along the groove between a first bit retaining position and a second bit non-retaining position. A method of assembly includes inserting opposing edges of the panel into opposing slots of the groove, and then connecting an end cap to the handle to prevent removal of the panel.

16 Claims, 7 Drawing Sheets

MULTIPLE BIT SCREWDRIVERS AND METHODS

FIELD OF THE INVENTION

The present invention relates generally to tools for transmitting torque. More particularly, the present invention relates to screwdrivers having multiple bits and handles configured to store the bits.

BACKGROUND OF THE INVENTION

Multiple bit screwdrivers are advantageous because they enable a user to drive a variety of screws with a single tool. Multi-bit screwdrivers typically include interchangeable bits having blades of varying sizes and styles. Exemplary styles of screwdriver blades include flathead, phillips, squarehead type, and torx type. By merely interchanging the bits, a user can drive different types of screws with a single tool.

A problem with multiple bit screwdrivers is that the bits can be easily misplaced or lost. To overcome this problem, a number of multiple bit screwdrivers have been developed that have handles equipped for storing multiple bits. Concerns in this area include cost to manufacture and ease of use. Reliability over the life of the screwdriver and an ability to quickly ascertain and select the appropriate bit for a particular use are also concerns. There is a need in the art for multiple bit screwdrivers and methods which address these concerns and other concerns.

SUMMARY OF THE INVENTION

The present invention relates to a screwdriver adapted for use with a replaceable bit. The screwdriver includes a shaft adapted to selectively form a torque transmitting engagement with the bit. A handle mounted on the shaft includes at least one outwardly opening groove sized and shaped for receiving and storing the bit. The groove preferably extends longitudinally along the length of the handle. The handle also includes a panel for selectively retaining the bit in the groove. The panel is constructed and arranged to slide along the groove between a first bit retaining position and a second bit non-retaining position. Preferably, plural grooves are provided to permit storage of plural bits in the handle. Panels sized smaller than the length of the bits allow the bit tips to be viewed when the panels are in the bit retaining positions.

The panels can be maintained in their desired positions by a variety of retention structures. Friction is an example of one such hold down system to keep the panels from moving to new positions at undesired times. Applying a pre-flex to each panel can assist in providing sufficient frictional hold down forces to keep each panel in its desired position during use.

Another aspect of the present invention relates to a method for assembling a screwdriver for use with at least one bit. The method includes the step of providing a handle body including at least one outwardly opening groove sized and shaped for receiving and storing the bit. The handle body also defines opposing slots extending longitudinally along opposite sides of the groove. The screwdriver is assembled by inserting opposing edges of a panel within the opposing slots of the handle body. As inserted, the panel is constructed and arranged to slide along the groove between a first bit retaining position, and a second bit non-retaining position. The method preferably includes the step of connecting an end cap to the handle body. The end cap prevents the panel from being removed from the opposing slots. Preferably, plural grooves and panels are provided, where the end cap prevents all of the panels from being removed from their respective slots.

The present invention provides a multiple bit screwdriver that is reliable, easy-to-use and cost effective to manufacture. The design of the screwdriver allows bits to be securely stored in the handle while concurrently allowing the bits to be quickly accessed when needed. Viewing of the bit tips while in the stored position is possible with the present invention. The present invention also provides a multiple bit screwdriver set designed to allow bits to be stored in the handle without interfering with the user's ability to tightly grasp the handle. The present invention further provides an efficient method of manufacturing a multiple bit screwdriver.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENTS

Reference will now be made in detail to preferred embodiments of the present invention which are illustrated in the accompanying drawings. Wherever possible, the same reference numbers will be used throughout the drawings to refer to the same or like parts.

Figure 1:
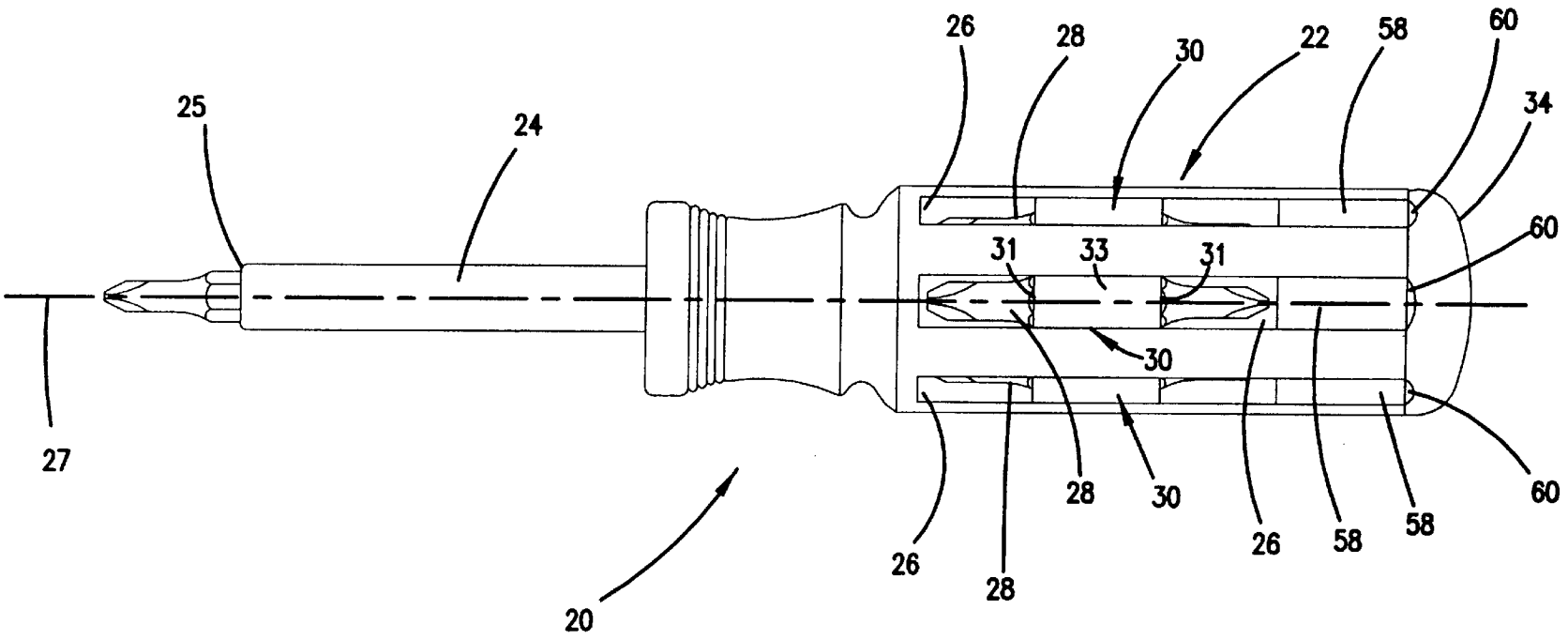
FIG. 1 shows a first preferred embodiment of a multiple bit screwdriver constructed in accordance with the principles of the present invention.

FIG. 1 shows an exemplary screwdriver 20 constructed in accordance with the principles of the present invention.

Generally, the screwdriver 20 includes a handle 22 sized to be grasped by the user's hand and connected to the end of a shaft 24. The handle 22 and the shaft 24 are aligned along a common longitudinal axis 27. The handle 22 includes a plurality of separate outwardly opening grooves 26. Each groove 26 has a length extending generally along the longitudinal axis of the screwdriver 20. A plurality of bits 28 are stored in the grooves 26, one per groove 26. The bits 28 are selectively retained in the grooves 26 by panels 30 that are constructed and arranged to slide longitudinally along the grooves 26. Each panel 30 is movable between a first retaining position (shown in FIG. 2) and a second non-retaining position (shown in FIG. 3). A distal end 25 of the shaft 24 opposite the handle 22 is configured to interchangeably receive each of the bits 28.

In general use, the grooves 26 allow the bits 28 to be conveniently stored in the handle 22 of the screwdriver 20. To move one of the panels 30 between positions, a user pushes on an engagement surface of the panel 30, such as an edge 31 or an outer surface 33 of the panel 30, to cause sliding movement of the panel 30. In certain embodiments, the outer surface 33 can include bumps, ridges or other structures for increasing the coefficient of friction of the surface 33 or otherwise provide a gripping surface.

When the panels 30 are oriented in the retaining positions, the bits 28 are securely captured within the grooves 26. Also, the bit tips can be viewed when the panels 30 are in the retaining positions due to their shorter length in the embodiment shown. To remove a selected bit 28 from the handle 22, the panel 30 securing the bit 28 is moved to the non-retaining position. Once the panel 30 is oriented in the non-retaining position, the selected bit 28 can be easily removed from its corresponding groove 26 in the handle 22 and inserted in the distal end 25 of the shaft 24. For example, the selected bit 28 can be lifted out or it will drop out of the handle 26 under the effects of gravity when the handle 22 is tipped or rotated such that the groove 26 containing the selected bit 28 faces at least partially in a downward direction.

Figure 2:
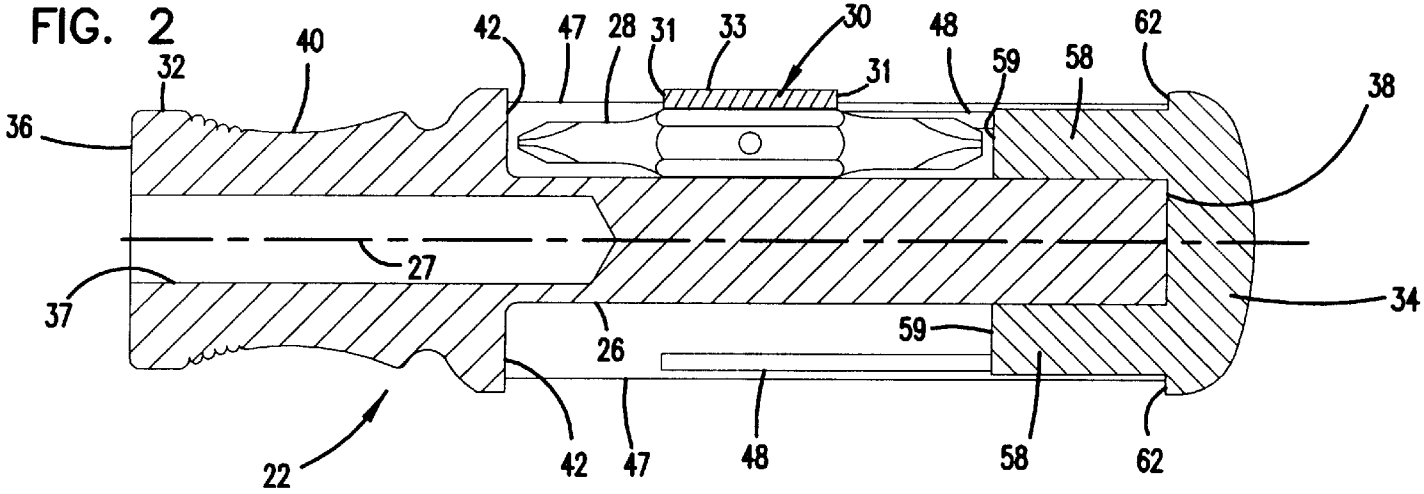
FIG. 2 is a longitudinal cross-sectional view of the screwdriver handle of FIG. 1, with a slide panel of the handle shown in a retaining position, the slide panel from an opposite side of the screwdriver has not been shown in order to illustrate interior features of the screwdriver.
Figure 3:
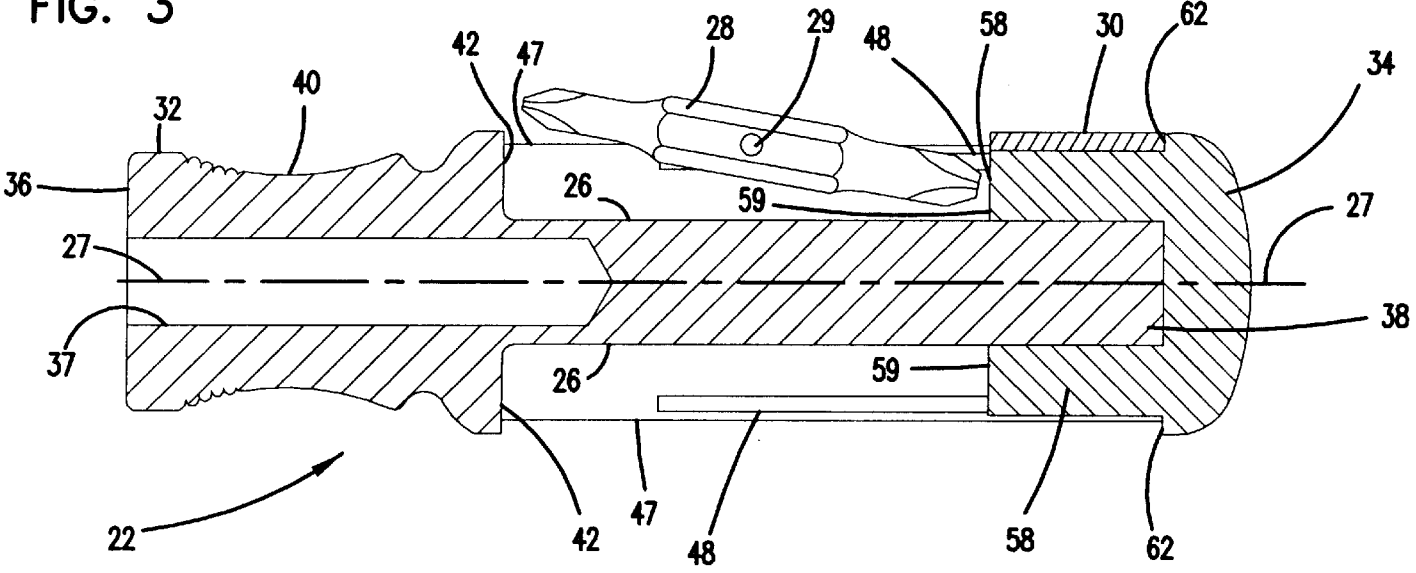
FIG. 3 is a longitudinal cross-sectional view of the screwdriver handle of FIG. 1, with the slide panel of the handle of FIG. 2 shown in a non-retaining position.

The bits 28 and the shaft 24 are preferably constructed of a material such as hardened steel. The bits 28 have opposite tips or ends configured to form screwdriver blades. As shown in FIGS. 1–3, the ends of the bits 28 shown are of the phillips type and have varying sizes. Exemplary alternative screwdriver blades suitable for use with the present invention include squarehead type, flathead and torx type blades. Of course, the bits 28 can be equipped with a variety of other structures suitable for transferring torque. The bits 28 can also be of the type having a single torque transmitting tip.

Figure 4:
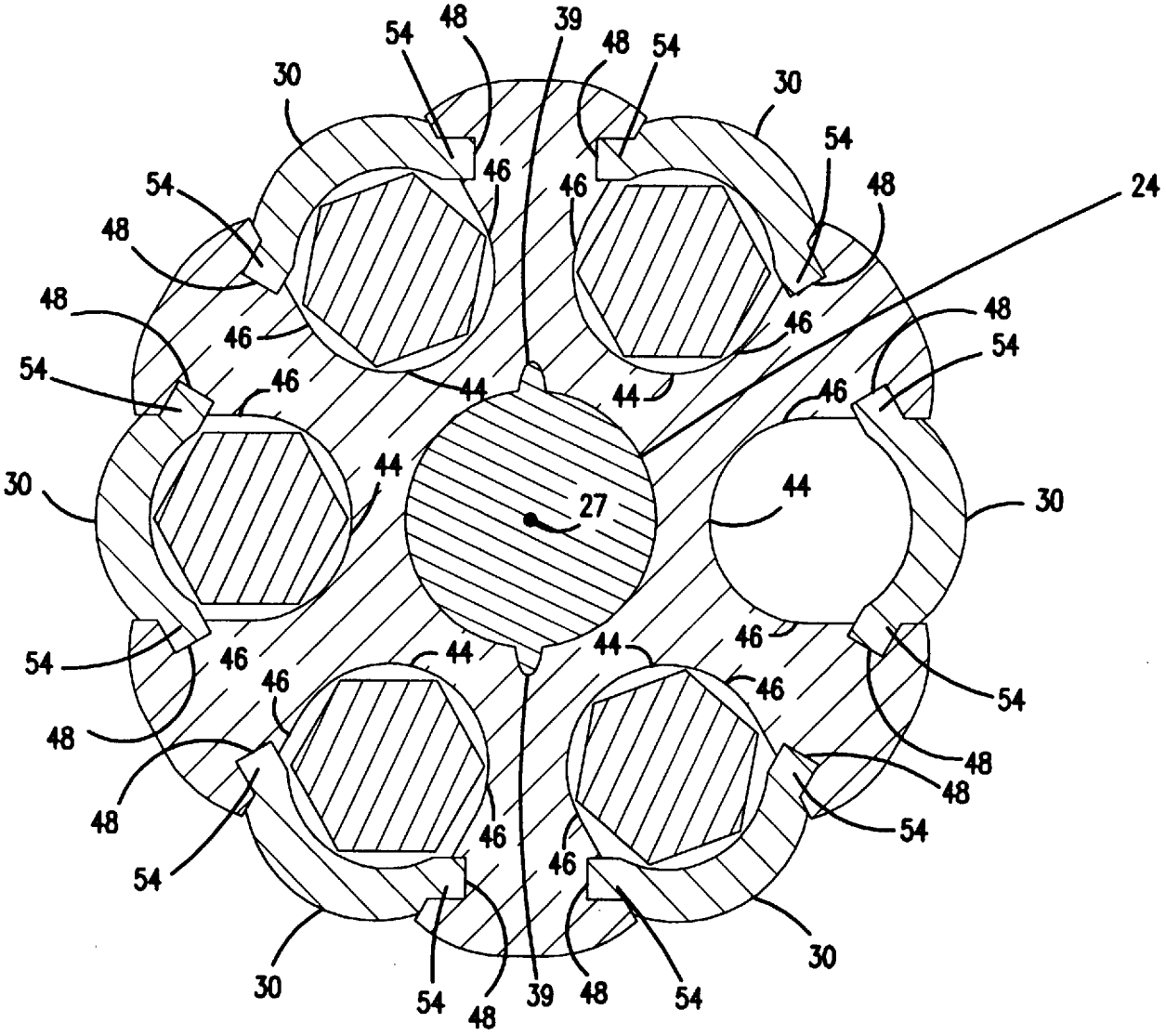
FIG. 4 is a transverse cross-sectional view of the screwdriver handle of FIG. 1, with the cross-section taken through the bits, panels, grooves and shaft.

The two-tipped bits 28 also include center portions adapted to each form a torque transmitting engagement with the distal end 25 of the shaft 24. For example, as shown in FIG. 4, the center portions of the bits 28 have hexagonal shaped cross-sections configured to mate with a corresponding hexagonal opening defined by the distal end 25 of the shaft 24. In alternative embodiments, numerous other known configurations can be utilized for transferring torque between the bits 28 and the distal end 25 of the shaft 24. For example, bits having a variety of polygonal shapes can be utilized. In the case of single tipped bits, the end opposite the torque transmitting tip is adapted to form a torque transmitting engagement with the distal end 25 of the shaft 24.

The bits 28 and the shaft 24 also include structure for securely and selectively retaining each bit 28 within the distal end 25 of the shaft 24. For example, each bit 28 can be equipped with a spring loaded detent ball 29. When one of the bits 28 is inserted in the distal end 25 of the shaft 24, the detent ball 29 of the bit is biased against an interior surface of the shaft 24. Friction between the detent ball 29 and the interior surface of the shaft 24 retains the bit 28 within the distal end 25 of the shaft 24. Alternatively, the bits 28 can be individually retained within the distal end 25 of the shaft 24 via other retention systems including a resilient clip, an o-ring, a moveable chuck, or magnetic attraction. An o-ring retention system is shown in U.S. Pat. No. 5,335,409, the disclosure of which is hereby incorporated by reference.

The handle 22 of the screwdriver 20 includes a main body portion 32, an end cap or end piece 34, and the plurality of slide panels 30. The main body portion 32 has a distal end 36 positioned opposite from a proximal end 38. A neck portion 40 is located adjacent to the distal end 36 of the main body portion 32. The main body portion 32 also defines the bit retaining grooves 26 of the handle 22. The neck portion 40 and the grooves 26 cooperate to assist a user in grasping the handle 22.

The main body portion 32 of the handle 22 includes a central axial opening 37 defined at the distal end 36 of the main body portion 32. The central axial opening 37 is configured to tightly receive a proximal end of the shaft 24. The shaft 24 is preferably retained within the opening 37 by conventional means such as a friction fit or an adhesive. Furthermore, as shown in FIG. 4, the shaft 24 also preferably includes protrusions 39 that project radially into interior grooves defined by the main body portion 32. The protrusions 39 prevent the shaft 24 from rotating relative to the handle 22. If desired, a removable shaft can be utilized, such as in U.S. Pat. No. 5,335,409.

The bit retaining grooves 26 of the handle 22 are preferably equally spaced about a circumference of the main body portion 32. More grooves, or fewer grooves than shown in the drawings can be used, including a single groove. Each groove 26 has a transverse shoulder or end wall 42 located generally adjacent to the neck portion 40. The grooves 26 extend in a proximal direction from the end walls 42 longitudinally throughout the length of the main body portion 32. As shown by the cross-section of FIG. 4, each groove 26 includes a rounded inner-most portion 44 extending between a pair of opposing substantially straight side walls 46. The side walls 46 define opposing longitudinal slots 48 each having a generally rectangular cross-section. The slots 46 are configured for receiving the panels 30 and extend proximally from a medial region of the main body portion 22 to the proximal end 38 of the main body portion 32. Outer edges 47 of the side walls 46 help to form gripping surfaces for the user to grip while turning the screwdriver 20 to drive or remove a screw.

The panels 30 of the handle 22 are shown having a length roughly equal to one third the length of each bit 28. Panels 30 of such a length are advantageous because even when the panels 30 are in the retaining positions, both ends of each bit 28 are still clearly visible. However, alternative embodiments of the present invention have panels of a variety of lengths. For example, each panel can extend the full length of each bit retaining groove 26. In such an embodiment, a selected panel would be moved in a longitudinal direction to expose its corresponding groove 26 for the purpose of storing or removing one of the bits 28. In the non-retaining position, each extended length panel would extend beyond the end piece 34. The extended length panel could be transparent to light to enable viewing of the bit when the panel is in the bit retaining position.

Figure 6:
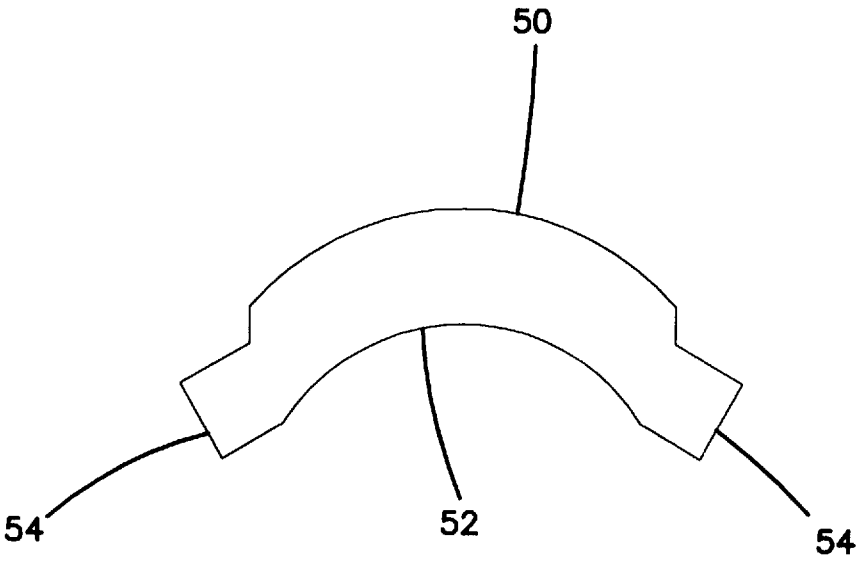
FIG. 6 is an enlarged end view of one of the slide panels of the screwdriver of FIG. 1.

FIG. 6 shows a cross-sectional view of one of the panels 30. As shown by the cross-sectional view, each of the panels 30 has a curved outer surface 50 and a curved inner surface 52. The outer and inner surfaces 50 and 52 are curved about a common center point. Angled wing members 54 are located on opposite sides of the panel 30. Each wing member 54 has a generally rectangular cross-section. The wing members 54 are sized to fit within the slots 48 defined by the main body 32 of the handle 22. By inserting the wing members 54 within the slots 48, a slidable connection is provided between the slide panels 30 and the main body 32 of the handle 22.

To maintain each panel 30 in the bit retaining position, friction and/or other retaining structure preferably exists between the wing members 54 and the portion of the main body 32 defining the slots 48. In the preferred embodiment, friction prevents the panels 30 from freely moving within the slots 48. Consequently, a force typically applied via a user's thumb or other finger, is needed to move the panels 30 from the retaining position to the non-retaining position. The friction hold down force is sufficient to maintain the panels 30 in the desired position during normal use of the screwdriver 20, such that the panels do not move at undesired times, whereby the bits 28 could fall out of their grooves 26. The relative sizes of the wings 54 and the slots 48 controls the amount of friction generated between the panels 30 and the main body 32, and also controls the force required to overcome the friction and slide the panels 30 within the slots 48. As will be discussed below, bending or flexing of the panels can be utilized to increase the friction between the slots 48 and the panels 30. By providing predetermined flexing of the panels along the slots 48 or in selected portions of the slots 48, additional friction hold down forces can be developed to guard against sliding of the panels 30 at undesired times. An example of other retaining structure for holding the panels 30 in the desired position includes locking tabs or detents between the panels and the handle body 32.

A friction fit and/or other retaining structure also preferably maintains each panel 30 in the non-retaining position after each panel is moved by the user to that position. Preferably, friction holds the panel 30 in the non-retaining position. To move the panel 30 back to the retaining position, the user applies a force to the panel 30 sufficient to overcome the friction hold down and/or other retaining structure and move the panel from the nonretaining position to the retaining position.

Figure 5:
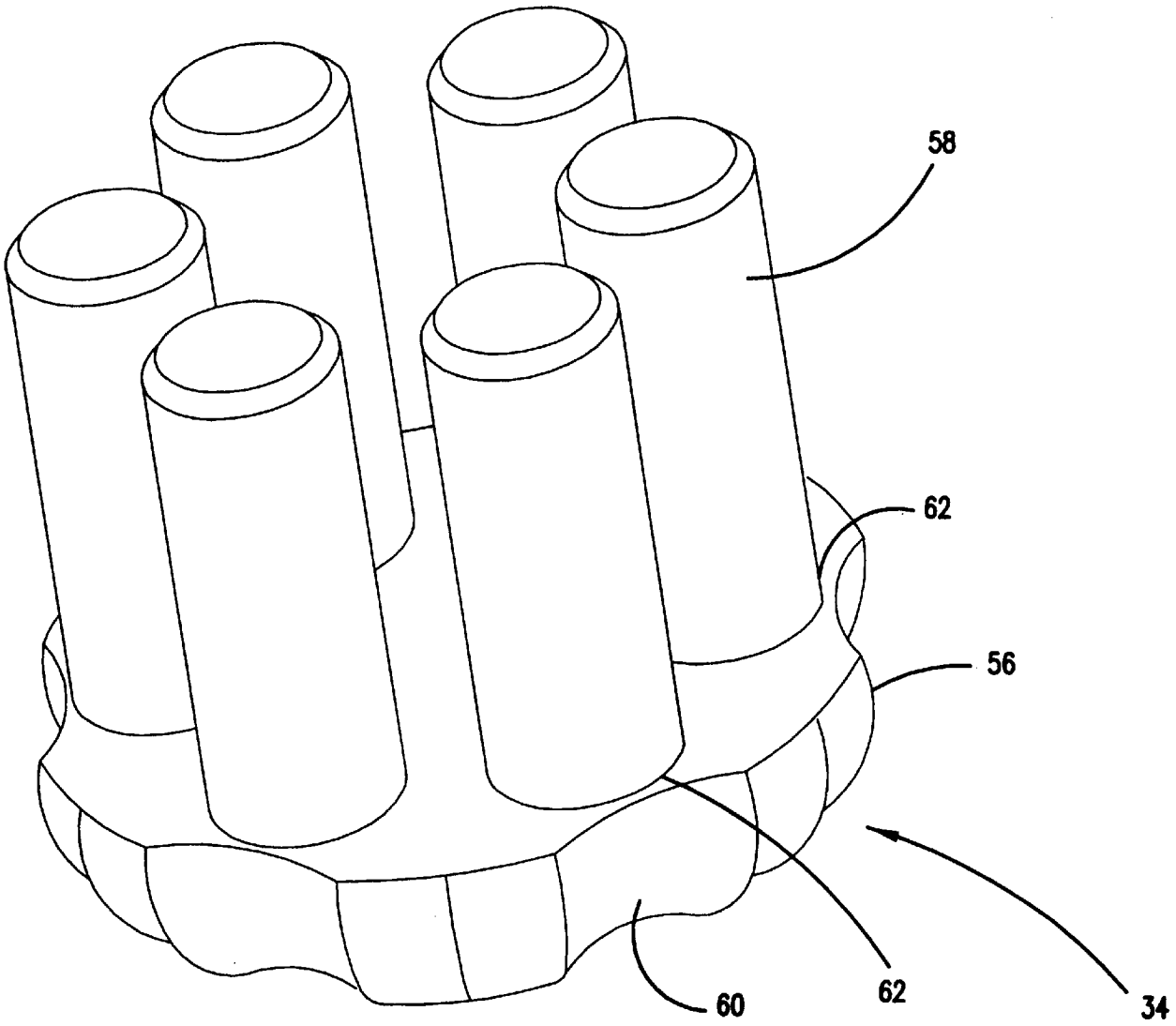
FIG. 5 is a perspective view of an end cap of the screwdriver handle of FIG. 1.

As shown in FIG. 5, the end cap 34 of the handle 22 includes a base 56 integrally formed with a plurality of cylindrical plug members 58. The plug members 58 project perpendicularly outward from the base 56 and are sized, shaped and arranged to be press fit into the proximal end 38 of the main body portion 32. Consequently, the plug members 58 are arranged in the same circumferential configuration as the grooves 26, and have diameters of approximately the same length as the diameters of the rounded inner-most surfaces 44 of the grooves 26. Adhesive can be used with, or instead of, the press fit between the plug members 58 and the main body portion 32. Also, a center plug (not shown) with optional wings can extend from the end cap 34 for a press fit and/or an adhesive bond with a recess provided in the proximal end 38 of the main body portion 32.

The ends of the plug members 58 are preferably beveled or tapered to facilitate inserting the plug members 58 within the grooves 26. As inserted in the proximal end 38 of the main body portion 32 of the handle 22, the plug members 58 are configured so as to not interfere with the slidability of the panels 30. As shown in FIG. 3, the panels 30 slide over the top of the plug members 58 when moved to the non-retaining position. As inserted in the grooves 26, the ends of the plug members 58 form proximal end walls 59 for limiting longitudinal movement of the bits 30 within the grooves 26.

The base 56 of the end cap 34 includes a plurality of depressions 60 which are spaced about a circumference of the base 56 and are in general alignment with the plug members 58. Shoulders 62 are formed between the plug members 58 and the depressions 60. When the end cap 34 is inserted within the proximal end of the main body portion 32, the shoulders 62 prevent the slide panels 30 from being removed from the slots 48. Additionally, the depressions 60 provide thumb or other finger clearance for facilitating moving each panel 30 from the non-retaining position to the retaining position.

The individual components of the handle 22 including the main body portion 32, the end cap 34, and the panels 30 are preferably separately molded of a plastic material. An exemplary material for manufacturing the components of the handle 22 includes a cellulose acetate, such as Tenite brand cellulose acetate from Eastman Kodak Company. If flexing of the panels 30 is provided to increase the friction hold down force, a different plastic material can be used for the panels 30 if the plastic material used for the main body portion 32 is not sufficiently flexible.

The screwdriver 20 is assembled by press fitting or otherwise attaching (permanently or temporarily) the shaft 20 within the axial opening 37 of the handle 22. The individual panels 30 are inserted within the slots 48 defined along the grooves 26. Once the panels 30 have been inserted in the slots 48, the end cap 34 is press fit or otherwise attached to the proximal end 38 of the main body portion 32 such that the panels 30 are prevented from being removed from the slots 48. With panels 30 in the nonretaining positions, the bits 28 are placed in the grooves 26. After the bits 30 have been placed in the grooves 26, the panels 30 are moved from the non-retaining positions to the retaining positions such that the bits 28 are secured within the handle 22.

Figure 7:
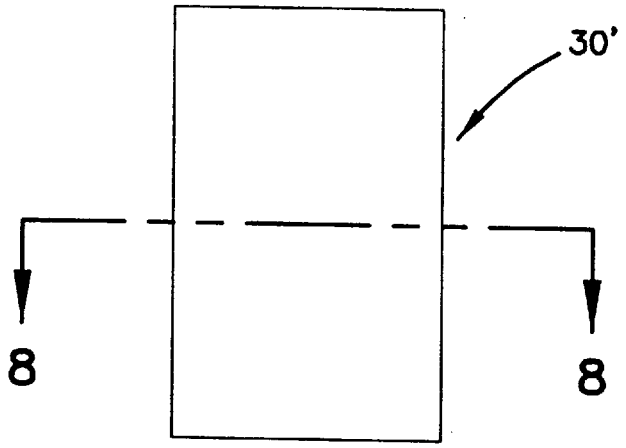
FIG. 7 is a plan view of an alternative slide panel.
Figure 8:
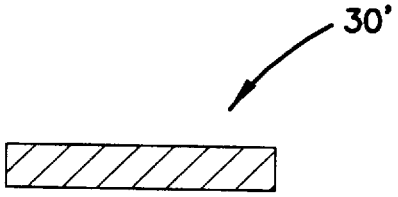
FIG. 8 is a cross-sectional view of the slide panel of FIG. 7 taken along section line 8—8.

FIGS. 7 and 8 illustrate an alternative slide panel 30' suitable for use in accordance with the principles of the present invention. As shown in the plan view of FIG. 7, the panel 30' is substantially rectangular. Similarly, as shown in the cross-sectional view of FIG. 8, the panel 30' has a substantially rectangular cross-section. The panel 30' is preferably constructed of a plastic material that allows flexing to a curved configuration. When the panel 30' is not inserted with a screwdriver handle, the panel 30' is substantially flat.

Figure 9:
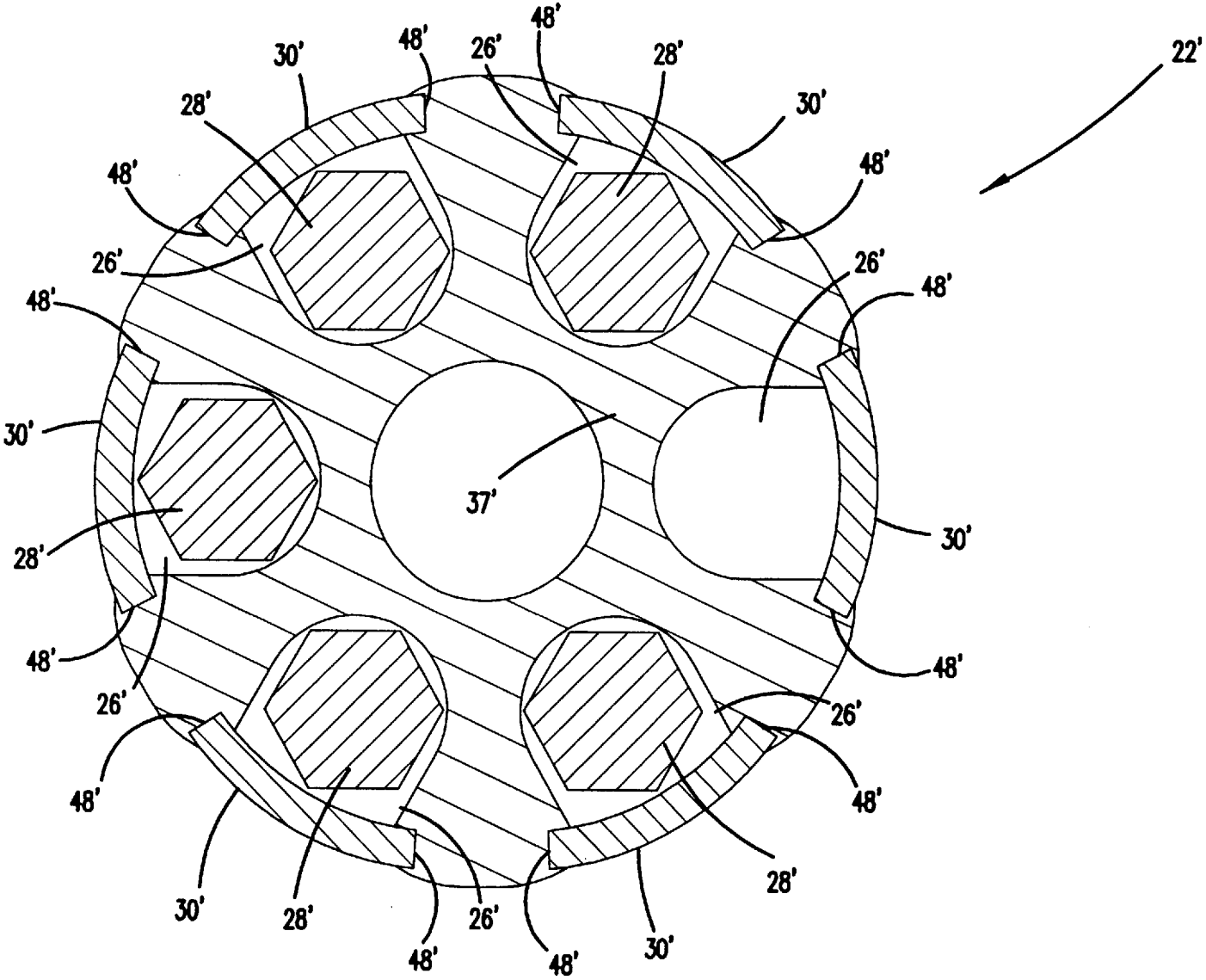
FIG. 9 is a transverse cross-sectional view of an exemplary screwdriver handle incorporating the slide panel of FIGS. 7 and 8.

FIG. 9 is a cross-sectional view of an exemplary screwdriver handle 22' incorporating the panels 30'. It will be appreciated that the handle 22' has a similar construction to the handle 22 illustrated in FIGS. 1–4. For example, handle 22' includes a main body portion 32' that defines a plurality of circumferentially spaced elongated grooves 26' configured for retaining bits 28'. Additionally, the handle 22' defines a central axial opening 37' for receiving a shaft.

The handle 22' also includes elongated slots 48' formed in opposite side walls of the grooves 26'. The slots 48' are configured for receiving the slide panels 30'. To insert the slide panels 30' within the slots 48', the panels 30' are flexed to enable the longitudinal edges of the panels 30' to be inserted within the slots 48'. The flexed panels 30' frictionally engage the portion of the handle 22 that defines the slots 48' such that a predetermined force is needed to move the panels 30'. It will be appreciated that the amount of force required to move a given panel 30' can be varied by varying the size and the flexibility of the panel 30', the width of the slots 48', the depth of the slots 48', or the angle of the slots 48' relative to the panel 30'. The width, depth or angle of the slots 48' can also be varied along the length of the grooves 26' so as to vary the amount of friction hold down when the panel 30 is moved between positions. For example, greater flexing of the panel 30' (which creates greater friction) may be desired in the retaining position than in the other positions. In the case of controlling the friction hold down force by varying depth, the slots 48' would be shallowest (causing more flexing) at the bit retaining position, and deepest (causing less flexing or no flexing) at the bit non-retaining position.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A screwdriver comprising:

a handle body including a radially outwardly opening exterior groove extending longitudinally along the handle body;

a bit adapted to be stored within the exterior groove, the bit extending longitudinally along the handle body when stored within the groove;

a panel for selectively retaining the bit in the groove, the panel being constructed and arranged to slide longitudinally along the groove between a first retaining position in which the panel is adapted to retain the bit within the groove, and a second non-retaining position in which the bit can be removed from or inserted into the groove; and a shaft secured to the handle body, the shaft including a bit receiving end, wherein the bit can be removed from the groove and inserted in the bit receiving end of the shaft.

2. The screwdriver of claim 1, wherein the handle body defines opposing slots extending longitudinally along L opposite sides of the groove, and the panel is slidingly mounted within the slots.

3. The screwdriver of claim 2, wherein the panel is substantially rectangular and is flexed between the opposing slots of the handle body.

4. The screwdriver of claim 2, wherein the panel has curved inner and outer surfaces, and includes oppositely positioned angled wing members that are received within the opposing slots of the handle body.

5. The screwdriver of claim 1, wherein the groove has closed ends such that the bit can not be removed axially from the handle.

6. The screwdriver of claim 5, wherein one of the closed ends of the groove is closed by an end cap fixedly secured to the handle body.

7. The screwdriver of claim 6, wherein the panel is retained in the handle body by the end cap.

8. A screwdriver for use with a plurality of bits, the screwdriver comprising:

a handle body defining a plurality of separate radially outwardly opening exterior grooves extending longitudinally along the handle body, the grooves being sized and shaped for receiving and storing bits such that the bits extend longitudinally along the handle body when the bits are stored in the grooves;

a plurality of panels for selectively retaining the bits in the grooves, the panels being constructed and arranged to slide longitudinally along the grooves between first retaining positions, and second non-retaining positions; and a screwdriver drive shaft secured to the handle body.

9. The screwdriver of claim 8, wherein the grooves are generally equally spaced about a circumference of the handle body.

10. The screwdriver of claim 8, wherein the handle body defines opposing slots extending longitudinally along opposite sides of each groove, and the panels are slidingly mounted within the slots.

11. The screwdriver of claim 10, further comprising an end cap connected to the handle body for retaining the panels within the slots.

12. The screwdriver of claim 11, wherein the end cap includes a base member and a plurality of plug members projecting transversely outward from the base member, the plug members being inserted within the grooves of the handle member to provide the connection between the handle member and the end cap.

13. The screwdriver of claim 12, wherein the panels are configured to slide over the plug members.

14. A screwdriver handle for storing a bit, the handle comprising:

a handle body configured to be grasped by a human hand, the handle body including a radially outwardly opening, elongated exterior groove sized and shaped for receiving and storing the bit such that the bit extends longitudinally along the handle body when the bit is stored in the groove, the handle body also defining an interior bore sized and shaped for receiving a screwdriver shaft; and a slide member for selectively retaining the bit in the groove, the slide member being constructed and arranged to slide longitudinally along the groove between a first retaining position, and a second non-retaining position.

15. A screwdriver for use with a bit, the screwdriver comprising:

a shaft having first and second ends, the first end adapted for selectively receiving the bit;

a handle body mounted to the second end of the shaft, the handle body including an outwardly opening groove extending longitudinally along the handle body, the groove being sized and shaped for receiving and storing the bit; and a panel for selectively retaining the bit in the groove, the panel being constructed and arranged to slide longitudinally along the groove between a first retaining position, and a second non-retaining position, wherein the bit has a first length, and the panel has a second length which is shorter than the first length of the bit.

16. The screwdriver of claim 15, wherein the second length of the panel is generally one-third the first length of the bit.

* * * * *